United States Patent [19]

Mizukawa et al.

[11] 4,446,350

[45] May 1, 1984

[54] INDUCTION HEATING COOKING APPARATUS

[75] Inventors: Takumi Mizukawa, Neyagawa; Keizo Amagami, Takatsuki; Yoshio Ogino, Nishinomiya, all of Japan

[73] Assignee: Matsushita Electric Industrial Co., Ltd., Osaka, Japan

[21] Appl. No.: 272,032

[22] Filed: Jun. 9, 1981

[30] Foreign Application Priority Data

Jun. 17, 1980 [JP] Japan ..... 55-82613

[51] Int. Cl.[3] ..... H05B 6/12; G08C 9/02

[52] U.S. Cl. ..... 219/10.77; 219/10.49 R; 340/365 C; 340/365 E; 200/DIG. 1

[58] Field of Search ..... 219/10.77, 10.49 R, 219/10.75, 506; 200/DIG. 1, 5 C, 5 D; 340/365 C, 365 E; 361/280, 281, 288; 307/116

[56] References Cited

U.S. PATENT DOCUMENTS

| | | | |
|---|---|---|---|
| 3,710,062 | 1/1973 | Peters, Jr. | 219/10.77 |
| 3,761,736 | 9/1973 | Edge et al. | 307/116 |
| 3,781,504 | 1/1973 | Harnden, Jr. | 219/10.77 |
| 3,819,906 | 6/1974 | Gould, Jr. . | |
| 3,877,029 | 4/1975 | Larson et al. | 340/365 C |
| 3,879,644 | 4/1975 | Maltby | 361/280 X |
| 3,886,539 | 5/1975 | Gould, Jr. . | |
| 3,887,781 | 6/1975 | Peters, Jr. | 219/10.49 R |
| 3,974,472 | 8/1976 | Gould, Jr. . | |
| 4,011,428 | 3/1977 | Fosnough et al. . | |
| 4,035,795 | 7/1977 | Fosnough et al. . | |
| 4,056,699 | 11/1977 | Jordan . | |
| 4,090,092 | 5/1978 | Serrano | 200/DIG. 1 |
| 4,169,222 | 9/1979 | Tucker | 219/10.49 R |
| 4,237,421 | 12/1980 | Waldron | 340/365 C |
| 4,290,052 | 9/1981 | Eichelberger et al. | 200/DIG. 1 |
| 4,308,443 | 12/1981 | Tucker et al. | 219/10.49 R |

*Primary Examiner*—B. A. Reynolds
*Assistant Examiner*—Philip H. Leung
*Attorney, Agent, or Firm*—Spencer & Frank

[57] ABSTRACT

An induction heating cooking apparatus includes a pan supporting plate made of a flat sheet of a heat-resistant dielectric material, a heating coil for induction heating disposed below the pan supporting plate, and touch pads each constituting a capacitor-pair formed by first, second and third electrodes. The touch pads when including three pads respectively serves for turning on a power supply, for turning off the power supply, and for setting a power level to a predetermined level. The induction heating or the supply of the power is permitted to take place only when the touch pad is first touched and followed by touching the touch pad. The first electrodes of the touch pads are provided on the upper surface of the pan supporting plate, and are enclosed by guard rings of a conductive material to prevent erroneous operation.

4 Claims, 6 Drawing Figures

INDUCTION HEATING COOKING APPARATUS

BACKGROUND OF THE INVENTION

The present invention relates in general to an induction heating cooking apparatus and in particular, relates to an induction heating cooking apparatus provided with an electrostatic capacitor type touch control device.

In heretofore known touch control device adopted in the cooking apparatus of this type, a plate made of a dielectric material such as a glass panel and serving as a control panel having a touch pad thereon is provided on a top or side surface of the cooking apparatus independently from a pan supporting plate. Since the control panel has to be mounted in a perfectly sealed state, the structure of the cooking apparatus would inevitably become quite complicated and expensive. Besides, water or watery spills boiled over from a pan disposed on the pan supporting plate would possibly interfere with the functions of the control panel, possibly resulting in a dangerous erroneous operation, if the control panel were disposed on the same plane as the pan supporting plate. For this reason, it has been impractical from the stand point of safety to provide the control panel on the same plane as the pan supporting plate.

SUMMARY OF THE INVENTION

Accordingly, an object of the present invention is to provide an induction heating cooking apparatus with a capacitor type touch control device designed to secure safety while retaining an enhanced usability.

According to an aspect of the invention an electrostatic capacitor type touch control device is provided on a pan supporting plate per se and a touch pad of the touch control device is enclosed by a guard ring thereby preventing erroneous control operation due to spills from the pan or the like.

According to another aspect of the invention, an infrared detector element for detecting the temperature of the pan and a display for allowing visual observation of the operation mode of the cooking apparatus are incorporated in the cooking apparatus for assuring reliable operation thereof.

According to a further feature of the present invention, control inputs are applied in two distinct steps in a predetermined sequence.

BRIEF DESCRIPTION OF THE DRAWINGS

The above and other objects, features and advantages of the present invention will become more apparent from the following description of preferred exemplary embodiments of the invention. The description makes reference to the accompanying drawings, in which.

Now, the invention will be described in detail in connection with preferred embodiments thereof by referring to the accompanying drawings.

DESCRIPTION OF THE PREFERRED EMBODIMENTS

Figure 1:
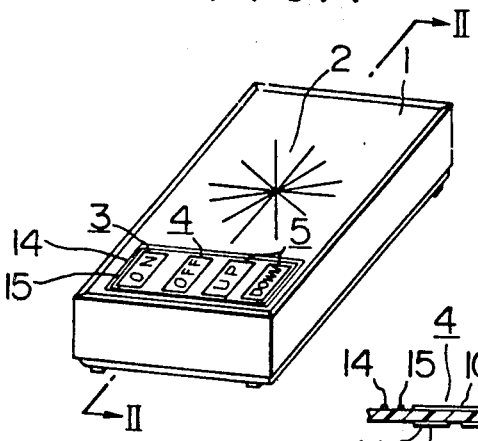
FIG. 1 is a perspective view of an induction heating cooking apparatus according to an embodiment of the invention.
Figure 2:
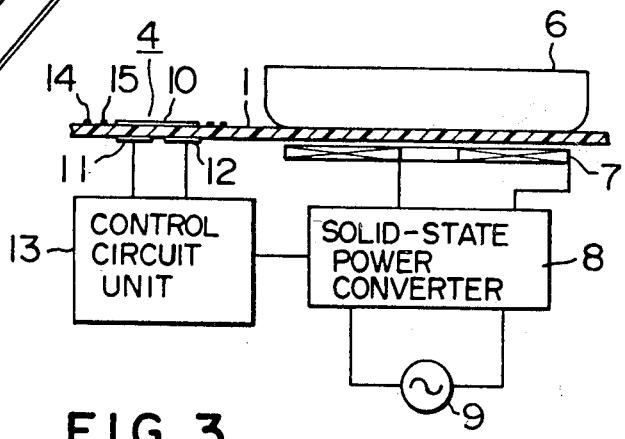
FIG. 2 is a partial sectional view (II—II' in FIG. 1) showing schematically the internal structure of the cooking apparatus.

FIG. 1 shows the outer appearance of the induction heating cooking apparatus. In this figure, a reference numeral 1 denotes a pan supporting plate on which there are provided a pan heating region 2 and touch pads 3, 4 and 5 for controlling the operations of the cooking apparatus. More particularly, the touch pad 3 serves to electrically connect the cooking apparatus to a power supply source, while the touch pad 4 is used to turn off the power supply, and the touch pads generally denoted by numeral 5 are intended for regulation of the power supplied to the cooking apparatus. Referring to FIG. 2 which shows in a partial sectional view the internal structure of the cooking apparatus, a reference numeral 6 denotes a cooking pan, 7 denotes an induction heating coil for heating the cooking pan 6, and numeral 8 denotes a solid-state power converter for converting power of a low frequency available from a low frequency power supply source 9 into power having an ultrasonic frequency to be supplied to the heating coil 7. The pan supporting plate 1 has the touch pad 4 constituting a capacitor-pair formed by first, second and third electrodes 10, 11 and 12. The first electrode 10, which is made of tin oxide or the like is mounted on the upper surface of the plate 1, made of a crystalline glassy ceramic. Further, the second and third electrodes 11 and 12 which may be constituted of silver epoxy resin or the like are mounted on the lower face of the pan supporting plate 1. The second and third electrodes 11 and 12 are located so as to partially oppose the common first electrode 10. A control circuit unit 13 is provided for controlling the solid-state power converter 8 in response to a variation in electrostatic capacity of the capacitor-pair formed by the first to third electrodes 10, 11, 12. For example, when the operator touches the first electrode 10, the electrostatic capacity between the electrode 10 and ground is inserted in the circuit, causing a corresponding variation in the overall capacitance of the capacitor-pair formed by the electrodes 10, 11, 12, which variation is made use of for various controls as is well known.

Figure 3:
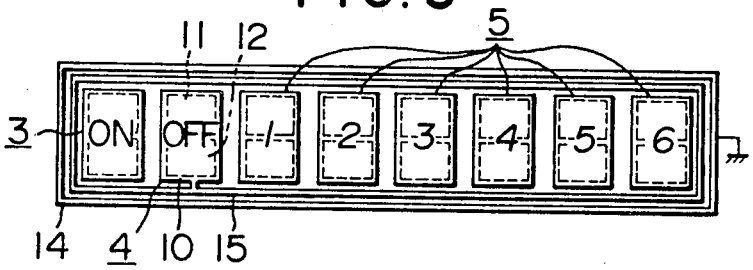
FIG. 3 shows in a plan view touch pads of a touch control device together with guard rings provided on a pan supporting plate of the cooking apparatus.
Figure 4:
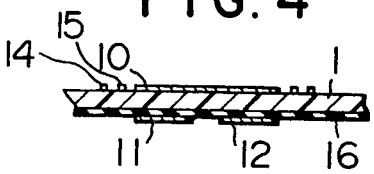
FIG. 4 shows in a partial sectional view another structure of a touch control device.

Referring to FIG. 3 which shows in detail an arrangement of touch pads 3, 4 and 5 each having the same structure as the touch pad 4 described above, there is provided guard rings composed of a grounded rectangular loop conductor 14 which extends around the touch pads 3, 4 and 5 and an inner loop conductor 15 which extends in parallel with the outermost loop conductor 14 on the inner side thereof, and is connected to the power turn-off touch pad 4. The touch pads 3 and 4 are respectively [ON] and [OFF] pads, and touch pads 5 includes [1], [2], [3], [4], [5] and [6] pads for setting the heating power at desired levels. The first electrodes 10 of the touch pads 3, 4 and 5 are arrayed as enclosed by the guard rings constituted by the loop conductors 14 and 15. In this connection, it will be noted that each of the first electrodes 10 is associated with corresponding second and third electrodes 11 and 12 provided at the lower surface of the pan supporting plate 1 to thereby constitutes a capacitor-pair of each touch pad. The second and third electrodes 11 and 12 may be constituted by copper foil or the like bonded to a film 16 of a material having a high dielectric constant such as polyethylene terephthalate (known as Mylar, trade name) or the like, wherein the film 16 is bonded to the lower surface of the pan supporting plate 1 simultaneously with provision of the lead wiring, as is illustrated in FIG. 4.

With the arrangement described above, referring to FIG. 3, a conductive liquid such as water or watery contents, which may possibly boil over from the pan 6 onto the touch pads 3, 4 and 5 will inevitably contact at first with the grounded loop conductor 14 before reaching the loop conductor 15 connected to the power turn-off pad 4, whereby the power supply is interrupted without fail. If the guard rings constituted by the loop conductors 14 and 15 are not provided, there may arise a danger that erroneous operations such as setting of power-up mode or uncontrollable operation would take place.

Figure 5:
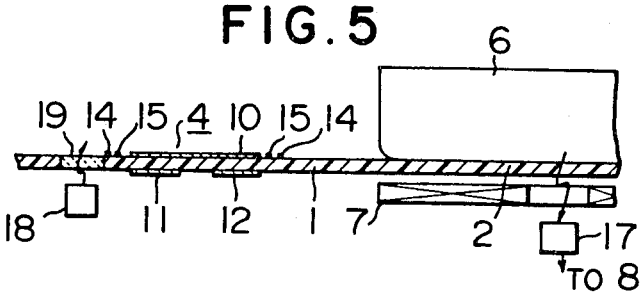
FIG. 5 shows in a partial sectional view another structure of the pan supporting plate which can be employed in the cooking apparatus according to the invention.

FIG. 5 shows another embodiment of the invention in which an infrared detector element 17 and a display 18 are additionally provided. In such a case where the pan supporting plate 1 is made of an opaque material, a portion of the pan supporting plate 1 is removed at a suitable location and the resultant notch is fitted with a transparent sheet material 19 such as reinforced glass or the like. The display 18 for indicating operation modes or which of the touch pads 3, 4, 5 is touched is positioned below the window defined by the transparent sheet material 19 to permit viewing of the display 18. The display includes LEDs or lamps connected to the ON output terminal of a latch circuit 24 (FIG. 6) and/or the output terminals of a latch circuit 21 by connections which are not shown. On the other hand, infrared detector element 17 is located below a center bore of the heating coil 7 for detecting directly infrared rays emitted from the pan 6. The output signal from the infrared detector element 17 which thus represents the temperature of the pan 6 is utilized for controlling the power converter 8 to thereby maintain the pan temperature at a constant value. Of course, it is possible to provide a touch pad for setting the pan temperature at a desired level in a similar manner as described hereinbefore, so that the pan temperature is controlled to be maintained at the set level on the basis of the output signal from the infrared detector element 17. By virtue of the arrangement whereby the temperature of the pan 6 can be directly detected in this way, overshooting in the temperature control is minimized, with the result that a pan supporting plate exhibiting a heat resistance capability up to about 250° C., which is usually the highest temperature appearing in cooking, can be used. Therefore, a pan supporting plate made of reinforced glass may be used. In this case, it goes without saying that the window notch for display can be omitted.

Figure 6:
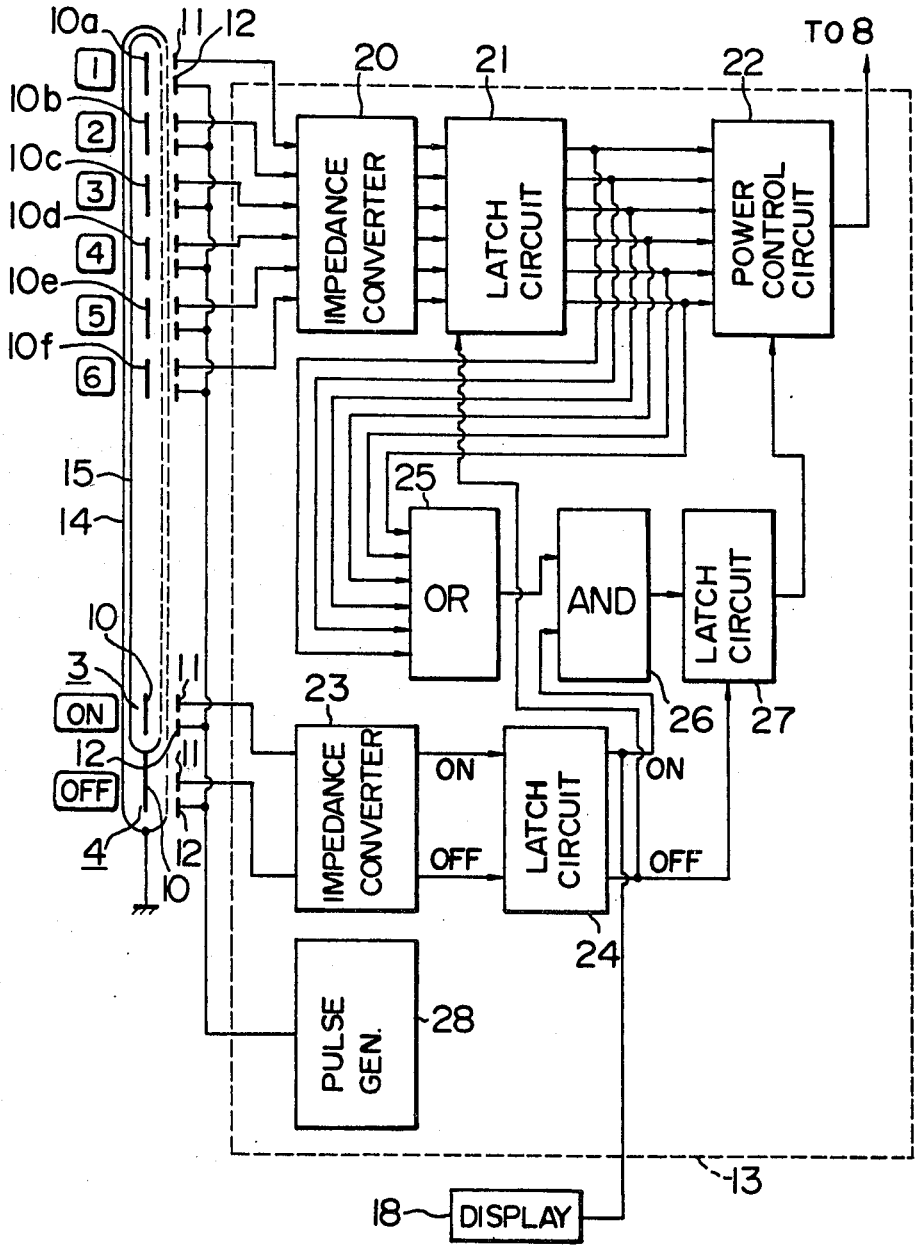
FIG. 6 is a circuit diagram of a control circuit which can be incorporated in the cooking apparatus according to the invention.

Next, a detailed description of the power control for the touch pads will be provided with reference to FIG. 6 in which the elements exhibiting the same functions as those shown in FIGS. 1 to 5 are denoted by the same reference numerals except that first electrodes of the touch pads [1], [2], [3], [4], [5] and [6] serving as the power control are identified by the reference symbols 10*a*, 10*b*, . . . , 10*f*. Referring to FIG. 6, reference numeral 20 denotes an impedance converter circuit which serves to detect the output signals from touch electrodes (first electrodes) 10*a* to 10*f* and converts them to signal levels suited for controlling the operations of succeeding stages. Numeral 21 denotes a first latch circuit for selecting and for self-holding only the touch pad or the touch electrode that has been last touched on the basis of the output signals from the impedance converter circuit 20. Reference numeral 22 denotes a power control circuit for controlling the output power level of the solid-state power converter 8 in accordance with the output signal from the latch circuit 21. Numeral 23 denotes a second impedance converter circuit which exhibits the same function as the impedance converter circuit 20 mentioned above and performs the signal level conversion of the signals produced from the power turn-on pad [ON] 3 and the power turn-off pad [OFF] 4. Reference numeral 24 denotes a second latch circuit wherein the state of one flip-flop is switched or changed over in response to the touch of one of the power turn-on and turn-off pads 3 and 4. It should, however, be noted that when both of the touch pads 3 and 4 are simultaneously touched, the second latch circuit 24 responds to the power turn-off pad 4 with reference over the power-on pad 3. Reference numeral 25 denotes an OR circuit which produces an output signal when any one of the touch electrodes 10*a*, 10*b*, . . . , 10*f* is touched. Numeral 26 denotes an AND circuit for producing a logical product of the output signal from the OR circuit 25 and the output signal "ON" from the latch circuit 24. Reference numeral 27 denotes a third latch circuit of which one flip-flop changes its state in response to the output signal from the AND circuit 26 and the output signal "OFF" from the latch circuit 24. Finally, a reference numeral 28 denotes a pulse generator for applying a pulse voltage to the inner or rear electrodes 12 in order to detect a touch of the touch electrodes 10*a*, 10*b*, . . . , 10*f* as well as the touch pads 3 and 4.

Next, the operation of the arrangement described above will be described. It is assumed that the apparatus is in the rest state with the power turn-off pad 4 having been touched. Then, the latch circuit 24 produces the output signal "OFF", whereby the latch circuit 24 is in the cleared state in which all the outputs are initialized or reset, for example, to zero level. The output signal "OFF" from the latch circuit 24 is also applied to the input of the latch circuit 27 which is thus initialized (e.g. to the zero output state). So long as the latch circuit 21 or 27 is in the initialized state, the power control circuit 22 can produce no output signal. As a consequence, the solid-state power converter 8 which is connected to the output of the power control circuit 22 remains in the rest state.

It is now assumed that the power turn-on pad 3 (more specifically the touch electrode 10 thereof) is touched. Then, the latch circuit 24 produces the output signal "ON", at the same time the output signal "OFF" disappears, resulting in the latch circuits 21 and 27 being changed over to the state ready for receiving the inputs thereto due to the disappearance of the output "OFF" signal. When a given one of the power setting electrodes 10*a* to 10*f* is touched at this time, then the latch circuit 21 produces a signal at the output terminal thereof which corresponds to the touch electrode as touched, with the result that the OR circuit 25 produces the corresponding output signal, which is then applied to the AND circuit 26 together with the output signal from the latch circuit 24. The AND circuit 26 thus produces the logical product signal of logic "1", whereby the state of the latch circuit 27 is reversed. Thereupon, the power control circuit 22 is enabled to receive the output signal from the latch circuit 21 and produces at the output a signal which controls the output power level of the solid-state power converter 8 to the level selected by the touched one of the power setting electrodes 10*a* to 10*f*. Even when any one of the power setting electrodes 10*a*, 10*b*, . . . , 10*f* is selectively touched prior to the physical touch of the power turn-on pad 3, the impedance converter circuit 20 is in the position to produce the level-converted signal at the output terminal thereof which corresponds to the power setting electrode as touched. However, since the latch circuit 21 accepts no input signal unless the power turn-on pad 3 has previously been touched, the output signal from the power control circuit 22 remains at the zero power level with the cooking apparatus remaining in the rest state. In other words, the power level setting can not be effected by means of the power setting electrodes 10*a*, . . . or 10*f* unless the power turn-on pad 3 has previously been touched. This two-step type power setting system assures safety, because both the power turn-on pad 3 and any one of the power setting electrodes 10*a*–10*f* must be touched before heating commences.

Operation of the aforementioned guard rings 14 and 15 will now be described. When spilled water or the like overflowing the pan contacts the grounded loop conductor 14 and the enclosing conductor 15 which is electrically connected to the power turn-off pad 4, then the same condition prevails as when there is a physical or finger touch of the user, resulting in the latch circuit 24 producing the signal "OFF" to set the power control circuit 22 at the zero power level. Further, even when the spill or the like extends over the power setting electrodes 10*a*, . . . , 10*f*, a corresponding power setting signal is positively prevented from being inputted to the power control circuit 22, because the input signal from the power turn-on pad 4 is given priority over the power setting signals, as described hereinbefore. Consequently, the output of the power control circuit 22 remains at the zero level, i.e. at the rest level.

The induction heating type cooking apparatus according to the invention brings about various advantages as follows:

(a) By virtue of such arrangement that the control touch pads are provided on the exposed flat surface of the pan supporting plate, and the touch electrodes of the touch pads are enclosed by the guard rings, not only dangerous erroneous operation can be prevented without fail, but also an improved structure of the induction heating cooking apparatus of this type which assures safe and easy use can be accomplished.

(b) Since the pan supporting plate made of a sheet of a transparent material or at least provided with a transparent portion or window is employed in combination with a display device disposed below the supporting plate or the window, it is possible to visually verify or check the state of the cooking apparatus at a position suited for visual observation.

(c) By providing the infrared detector element at a position suited for detecting the pan temperature through the interposed pan supporting plate, it is possible to obtain highly accurate temperature control without overshooting, which is a great advantage in cooking. Additionally, the temperature of the pan supporting plate will not increase beyond a maximum of about 250° C. at even when the use of the pan is abnormal as when it is heated in the empty state. Thus, an inexpensive transparent sheet material such as reinforced glass sheet or the like may be used for the pan supporting plate.

(d) Further, because no heating takes place unless the power turn-on touch pad is touched first, followed by touching of the power setting pad, erroneous operation due to an inadvertent touch on the pad can be excluded, whereby high security cooking apparatus is provided.

What is claimed is:

1. An induction heating cooking apparatus comprising a flat pan supporting plate made of a heat-resistant dielectric material for supporting a pan thereon, said plate having upper and lower surfaces;

a heating coil for induction heating of said pan, said heating coil being positioned under said pan supporting plate;

a power source for supplying a high frequency current to said heating coil;

a first touch pad for producing a first signal to effect turning on of said power source upon being touched with a finger;

a second touch pad for producing a second signal to effect turning off of said power source upon being touched with a finger;

a third touch pad for producing a third signal to effect setting of a power level of said power source to a predetermined level;

each of said first, second and third touch pads constituting a capacitor-pair formed by a first electrode attached to the upper surface of said pan supporting plate and second and third electrodes respectively mounted on the lower surface of said pan supporting plate, the capacitance of the capacitor-pair being varied when the first electrode is touched;

a control circuit connected to said first, second and third touch pads and said power source for controlling the supply of said high frequency current from said power source in response to said first, second and third signals from said first, second and third touch pads;

a first guard ring made of a conductive material formed on the upper surface of said pan supporting plate enclosing said first electrodes of said first, second and third touch pads, said first guard ring being connected to said first electrode of said second touch pad; and a second guard ring made of a conductive material formed on the upper surface of said pan supporting plate enclosing said first guard ring, said second guard ring being grounded.

2. An induction heating cooking apparatus according to claim 1 which further comprises a dielectric layer interposed between the lower surface of said pan supporting plate and said second and third electrodes, and wherein said first electrode is made of tin oxide and said second and third electrodes are made of silver epoxy resin.

3. An induction heating cooking apparatus according to claim 1 wherein said first and second guard rings have a substantially rectangular shape and extend parallel to each other.

4. An induction heating cooking apparatus according to claim 1 wherein an OFF signal is produced from said second touch pad when said first and second guard rings are conductively connected to each other by spilled liquid and no output signal is applied by said control circuit when said OFF signal is produced.

* * * * *